United States Patent [19]

Frangel

[11] Patent Number: 4,852,431

[45] Date of Patent: Aug. 1, 1989

[54] AUTOMATICALLY ADJUSTABLE THREADED CAP LOOSENING APPARATUS AND METHOD

[76] Inventor: William L. Frangel, 2012 Jenner La., St. Louis, Mo. 63138

[21] Appl. No.: 191,996

[22] Filed: May 9, 1988

[51] Int. Cl.[4] ..... B67B 7/18

[52] U.S. Cl. ..... 81/3.2; 81/3.32; 81/3.33; 81/3.44; 81/3.39

[58] Field of Search ..... 81/3.2, 3.25, 3.31, 81/3.32, 3.33, 3.36, 3.37, 3.39, 3.4, 3.42, 3.44

[56] References Cited

U.S. PATENT DOCUMENTS

| | | | |
|---|---|---|---|
| 2,897,699 | 8/1959 | Anderson | 81/3.33 |
| 3,795,158 | 3/1974 | Morita | 81/3.32 |
| 4,171,650 | 10/1979 | Cardinal | 81/3.2 |
| 4,762,029 | 8/1988 | Chen | 81/3.32 |

FOREIGN PATENT DOCUMENTS

| | | | |
|---|---|---|---|
| 469789 | 11/1950 | Canada | 81/3.44 |
| 325922 | 9/1920 | Fed. Rep. of Germany | 81/3.39 |

*Primary Examiner*—Roscoe V. Parker

*Attorney, Agent, or Firm*—Polster, Polster and Lucchesi

[57] ABSTRACT

An apparatus for loosening threaded caps assembled to upper ends of containers is disclosed as including a de-capping assembly for circumferentially engaging and loosening a threaded cap from an associated container. The de-capping assembly is capable of being automatically adjustably pre-positioned relative to threaded caps of different diameter assembled to associated containers. In conjunction with the de-capping assembly, an elevator assembly may also be used for vertically and horizontally aligning a threaded cap mounted container relative to the de-capping assembly. A method is also disclosed for adjustably and circumferentially gripping threaded caps of different diameter assembled to associated containers and imparting circumferential loosening forces to such threaded caps assembled to associated containers while retaining the circumferential gripping force.

17 Claims, 5 Drawing Sheets

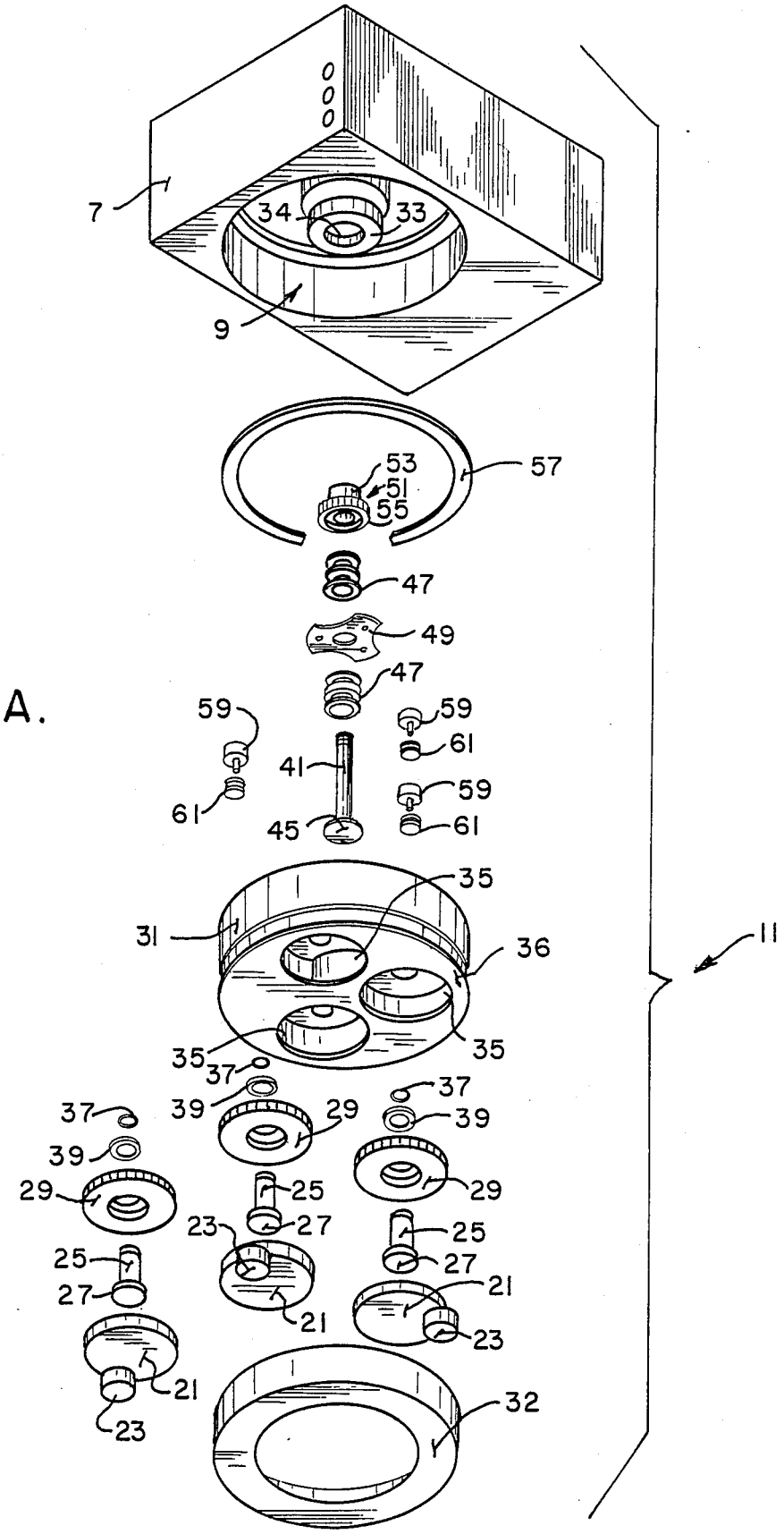
FIG. 4.A.

AUTOMATICALLY ADJUSTABLE THREADED CAP LOOSENING APPARATUS AND METHOD

BACKGROUND OF THE INVENTION

The present invention relates to an apparatus and method for loosening threaded caps assembled to upper ends of containers, and more particularly to a method and apparatus for automatically adjustably pre-positioning of a circumferential gripping mechanism relative to threaded caps of different diameter assembled to associated containers, and thereafter imparting circumferential loosening forces to such threaded caps while retaining the circumferential gripping forces, in order to loosen threaded caps assembled to associated containers.

There has long existed an unfulfilled need for an apparatus and method which automatically adjusts to and then loosens a variety of different sized threaded caps assembled to associated containers. As is well known today, a variety of different types, sizes and styles of threaded caps/lids/closures are used with a variety of containers. For example, tamper-proof frangible aluminum closures are often used in beverage bottles ranging from 10 ounces up to 2 liter sizes. To separate the threaded cap from its associated container, a frangible connection must first be broken, and then the cap may be loosened and unthreaded from the container. An entirely different type of threaded cap is used with large pickle and peanut butter jars. With such jars, a large diameter metal crown closure, threadably mounted to the jars, must be threadably loosened and then disassociated from the jars. These are two examples of the many and different types, sizes and styles of threaded caps which are in use.

As is also well known, substantial untorquing forces are required to break the frangible connection and/or overcome the carbonation or vacuum packing pressure or tightening pressure following filling of a container. Once the cap or closure seal is loosened or "broken", it is relatively easy to unthread a cap or closure from its associated container. However, almost everyone has encountered a situation where hot water, striking the cap with a heavy object at a variety of circumferential positions or some other auxiliary gripping component, has been used to loosen or "break" the seal between a threaded cap and its associated container, to overcome the untorquing force necessary for loosening the threaded caps.

Adults in the prime of life are expected to remove threaded caps from containers; however, this situation is not so easily faced by the young and the old. The young have parents or guardians who are expected to remove threaded caps from containers, but the "vintage" generation, those 50 years and older usually live by themselves or with a spouse only. Since physical strength deteriorates, as people age, it becomes more and more difficult for older adults to loosen and then remove threaded caps from containers, particularly in view of the increasing use of tamper proof features used with threaded caps to prevent unauthorized removal of threaded caps from associated containers.

As can be expected, there have been numerous developments related to threaded cap loosening removal; however, the apparatus and methods which have been developed to date are generally limited to loosening bottle caps, in one instance, and loosening of large jar lids, in the other. Examples of bottle cap loosening apparatus and mechanisms include U.S. Pat. No. 3,545,174 which discloses a single lane indexing device and bottle cap decrowning mechanism operating while bottles move in a horizontal path; U.S. Pat. No. 3,867,854 which discloses a pivoted cap removal device powered by an electric motor which deforms a metal cap attached to a bottle to free the cap from the bottle; U.S. Pat. Nos. 3,894,448 and 3,942,395 which disclose cap removing levers extending within a passageway that receives and removes a bottle cap assembled to a container; and U.S. Pat. No. 4,358,970 which discloses a power driven bottle cap remover having cap engaging means that grip and twist a crown cap loose from its associated bottle. With respect to threaded jar lid removal mechanisms, representative examples are shown by U.S. Pat. No. 3,812,742 which has a suction gripping device that grips and then rotates a threaded cap while its associated jar is retained in a fixed position; U.S. Pat. No. 3,950,801 which discloses a vertically movable friction chuck that engages the upper surface of a threaded lid, while the associated container is held in a fixed position; U.S. Pat. No. 4,102,226 discloses a jar opening apparatus including a gripping plate which is vertically movable into and out of engagement relative to a jar cap to be removed; U.S. Pat. No. 4,171,650 which discloses a jar lid loosening device including a jar lid friction engaging surface which holds the jar lid while permitting rotation thereof to loosen the jar lid; and U.S. Pat. No. 4,569,281 which discloses upper and lower resilient jar gripping means that cooperate to drive segments of a cap engaging member to produce a loosening force to unscrew a jar cap from its associated container.

From the above, it can be seen that the prior art has generally developed separately with respect to bottle cap and jar cap removal mechanisms and apparatus, primarily because the prior art has not been adaptable to a variety of different size threaded lids assembled to bottles and/or jars. Thus, it is apparent that there remains a long and unfulfilled need for an apparatus and method which automatically adjusts to and then loosens threaded caps of various diameters shapes and sizes which are assembled to a variety of containers.

SUMMARY OF THE INVENTION

Among the several objects and advantages of the present invention include:

The provision of an apparatus for loosening threaded caps of various diameters assembled to upper ends of containers;

The provision of such an apparatus which automatically adjustably pre-positions, circumferentially grips and loosens threaded caps of various diameters from associated containers;

The provision of such aforementioned apparatus which includes a de-capping mechanism that circumferentially grips and loosens a threaded cap from an associated container while also being automatically adjustably pre-positioned relative to threaded caps of different diameters assembled to associated containers;

The provision of such aforementioned apparatus which includes, through the anticipated range of threaded caps and bottle and jar sizes, an infinitely adjustable circumferential cap gripping and loosening mechanism to assist in removing threaded caps from containers;

The provision of such aforementioned apparatus which further includes an elevator mechanism for raising and lowering a threaded cap mounted container into position for loosening of the threaded cap from the container;

The provision of such aforementioned apparatus with an included elevator mechanism that facilitates one-handed operation of the apparatus requiring only the raising and lowering of a threaded cap mounted container into and out of cap loosening position;

The provision of a method for loosening threaded caps from associated containers including adjustably and circumferentially gripping and loosening threaded caps of different diameters from associated containers; and The provision of the aforementioned method which further includes automatically adjustably pre-positioning of a circumferential gripping force relative to threaded caps of different diameter assembled to associated containers.

Briefly stated, an apparatus for loosening threaded caps assembled to upper ends of containers according to the present invention includes de-capping means for circumferentially engaging and loosening a threaded cap from its associated container. The de-capping means is automatically adjustably pre-positioned relative to threaded caps of different diameter assembled to associated containers. Elevator means for vertically and horizontally aligning a threaded cap of a threaded cap mounted container may also be provided for positioning the threaded cap relative to the de-capping means to provide the aforesaid loosening and de-capping operation.

In addition to the foregoing, the method of the present invention, for loosening threaded caps assembled to upper ends of containers, includes the steps of adjustably and circumferentially gripping threaded caps of different diameter assembled to associated containers with a continuous circumferential gripping force, and imparting circumferential loosening forces to threaded caps assembled to associated containers while retaining the continuous circumferential gripping force. The continuous circumferential gripping force is automatically adjustably pre-positioned relative to threaded caps of different diameter assembled to associated containers.

BRIEF DESCRIPTION OF THE DRAWINGS

In the drawings,

FIGS. 4A and 4B, are exploded isometric views which illustrate each of the components of the de-capping mechanism of the present invention;

DESCRIPTION OF THE PREFERRED EMBODIMENT

In the discussion that is to follow, it is to be understood that the automatically adjustable threaded cap loosening apparatus and method of the present invention is constructed to loosen threaded caps of various diameters, sizes and shapes assembled to associated containers. Thus, while no specific type of threaded cap is referred to in the following discussion, it will be understood that working models of the present invention have successfully loosened threaded caps ranging from beverage bottle closures to very large pickle jars or peanut butter closures, and threaded child resistant closures all of which as well as other sizes and shapes being within the scope of operation of the present invention.

Figure 1:
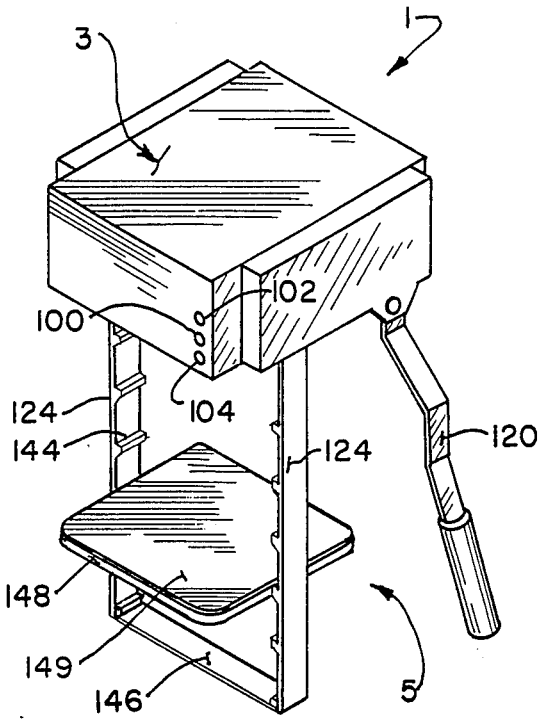
FIG. 1 is an isometric view of an apparatus for loosening threaded caps assembled to upper ends of containers, including a de-capping mechanism and an elevator mechanism constructed in accordance with the teachings of the present invention.

The principal components of the threaded cap loosening apparatus 1 are shown in FIG. 1 as including a de-capping mechanism or assembly 3 and an elevator mechanism or assembly 5 which raises and lowers a threaded cap mounted container into and out of position relative to the threaded cap mechanism or assembly 3. The elevator mechanism 5, shown in FIGS. 1 and 5–7 of the drawings has been developed principally for one-handed operation by handicapped persons, as will be discussed hereafter. Thus, the threaded cap loosening apparatus 1 of the present invention may also be used solely with the de-capping mechanism or assembly 3, which is shown in FIGS. 1–4 and 8–11 of the drawings, now to be described.

Figure 3:
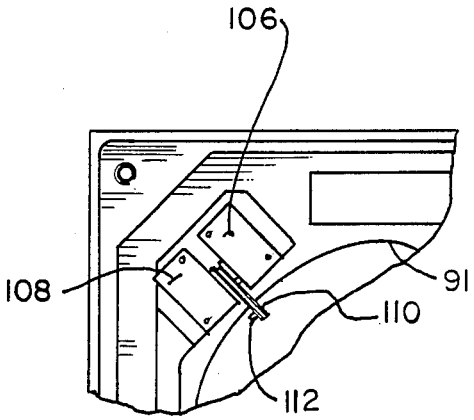
FIG. 3 is an enlarged fragmentary top plan view illustrating the reversing and stopping components associated with the de-capping mechanism of the present invention.
Figure 2:
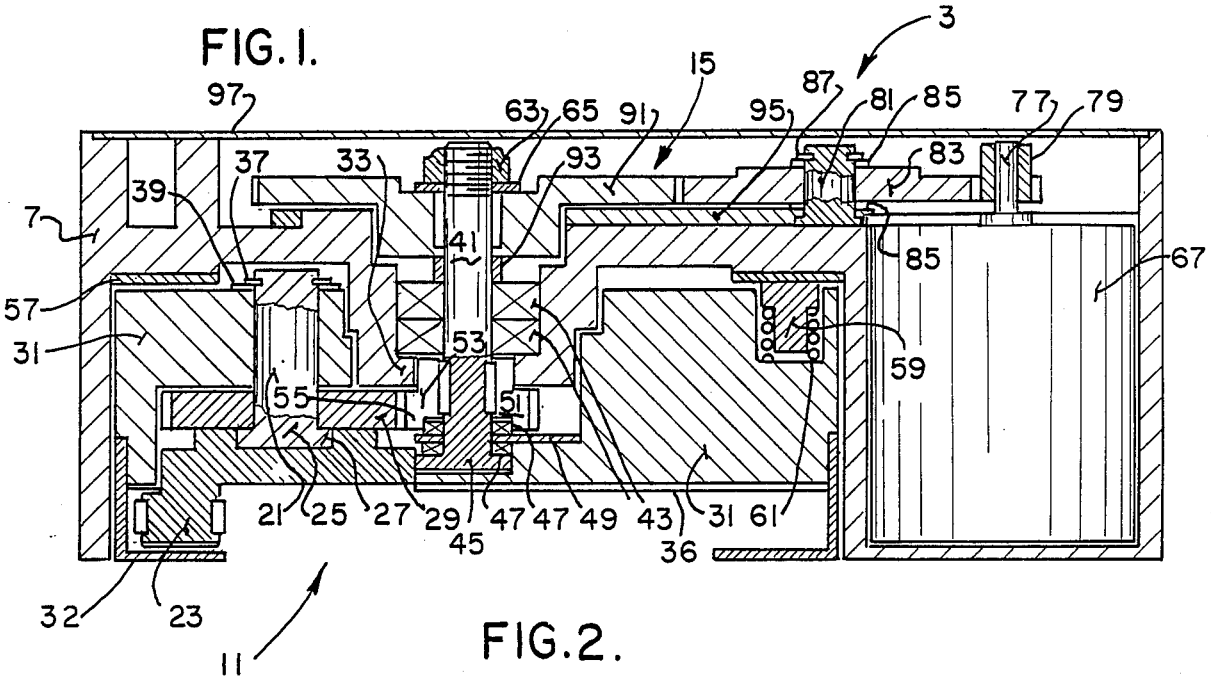
FIG. 2 is an enlarged sectional view illustrating the components of the de-capping mechanism of the present invention.
Figure 4B:
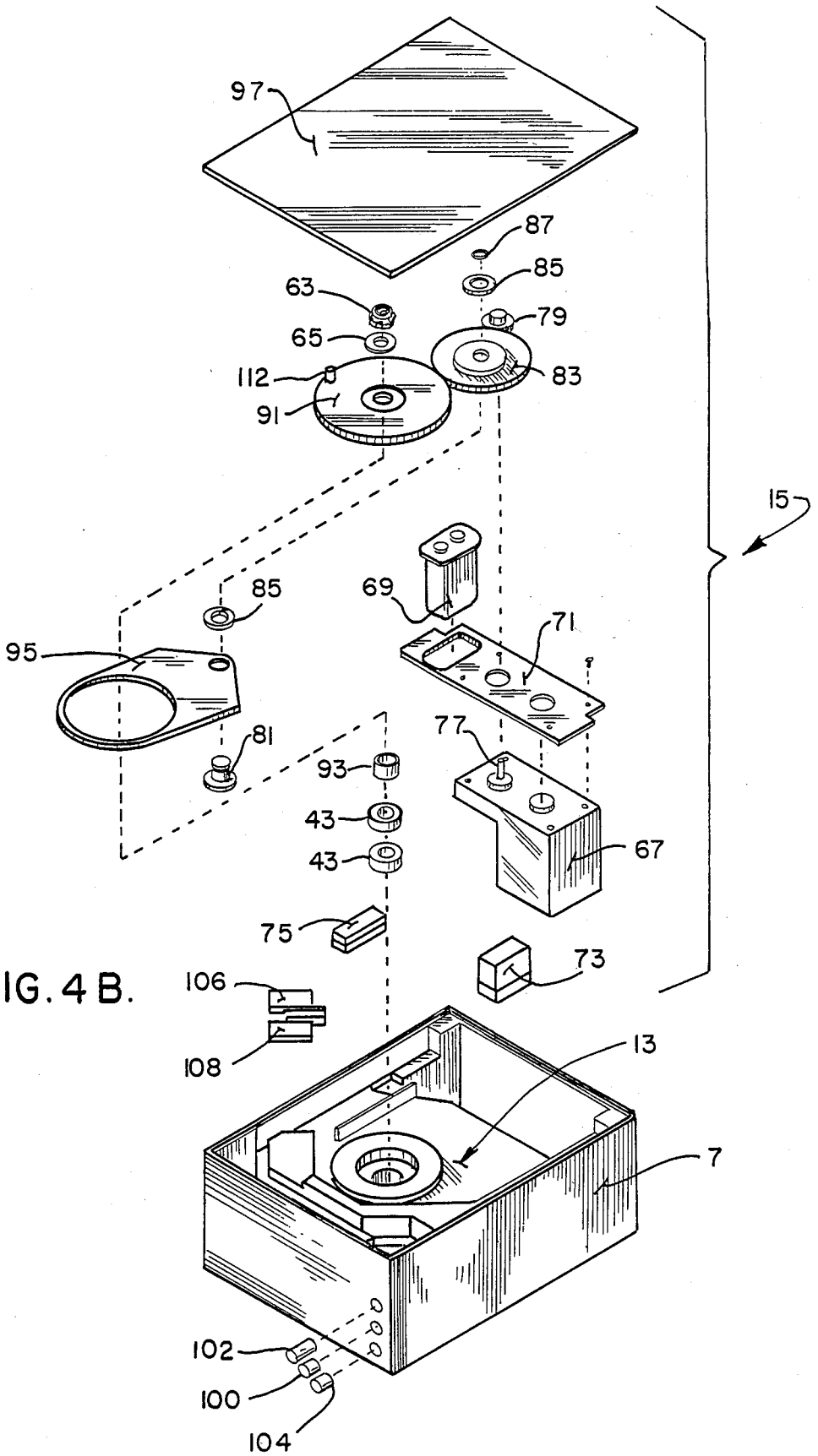
Figure 5:
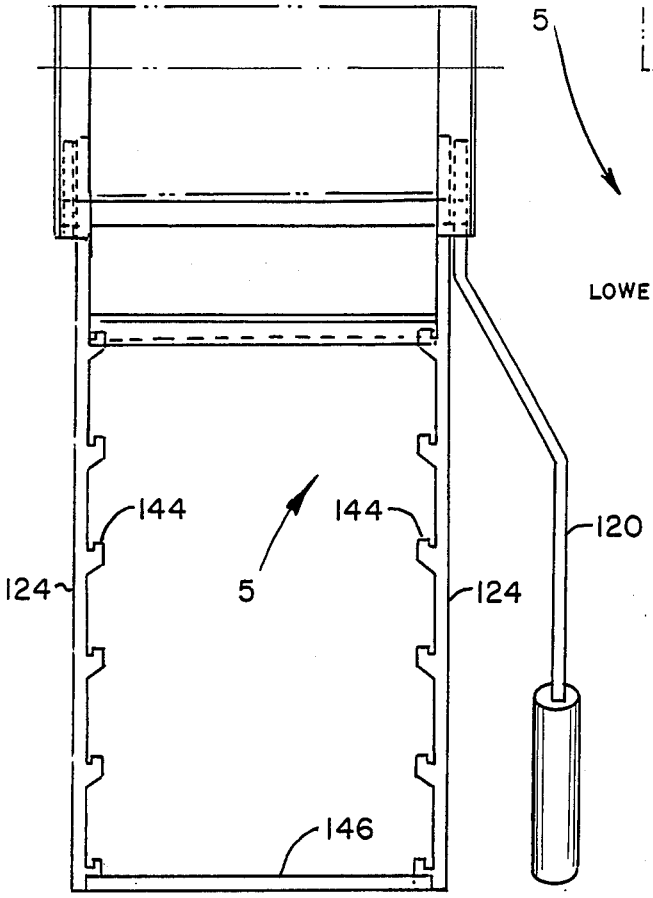
FIG. 5 is an elevational view of the jar loosening apparatus, primarily the elevator mechanism for raising and lowering a threaded cap mounted container relative to the de-capping mechanism.

To facilitate an understanding of the components and operation of the de-capping mechanism or assembly 3, FIG. 2 of the drawings shows the assembled components of the de-capping mechanism or assembly 3, FIG. 3 illustrates stopping and reversing components, and FIGS. 4A and 4B show exploded isometric views of the various components which comprise the de-capping mechanism or assembly 3. Reference is now made to these FIGS. 2–4 for a description of the various components and operation of the de-capping mechanism or assembly 3 of the present invention.

The de-capping mechanism or assembly 3 includes a main body frame 7 having a lower cavity 9 which receives the rotatable cap gripping and loosening mechanism 11, and an upper cavity 13 which receives the power or drive train mechanism 15 that operates the rotatable cap gripping and loosening mechanism 11. Each of the lower and upper cavities 9, 13 respectively are configured and shaped to receive the various components of the rotatable cap gripping and loosening mechanism 11 and power or drive train mechanism 15, as will be appreciated.

The rotatable cap gripping and loosening mechanism 11 includes three cap gripper wheels 21 having eccentrically positioned cap gripper bands 23 for circumferential gripping of threaded caps, as will be discussed in detail hereafter. Each of the cap gripper wheels 21 have a cap gripper shaft 25 with an enlarged head 27. Rigidly attached to the cap gripper wheels 21 are planetary gears 29 which are freely rotatably mounted on the cap gripper shafts 25, but by reason of being rigidly attached to the cap gripper wheels 21, rotate the cap gripper wheels 21, including the eccentrically mounted gripper bands 23, when the planetary gears 29 are operatively driven, as will be described hereafter.

Each of the cap gripper shafts 25 are fixedly attached to a rotatable outer ring 31 which is rotatably mounted on an integral upstanding hub 33 included within the body 7 and extending within the lower cavity 9. The rotatable outer ring 31, lower surface covered with a high friction membrane 36, has three corresponding openings 35 which receive the cap gripper shafts 25, associated planetary gears 29, and cap gripper wheels 21 to mount the same there within. It will be noted that each of the cap gripper shafts 25 are attached to the rotatable outer ring 31 on the reverse face thereof by snap rings 37 which fit over thrust bushings 39 to secure the cap gripper shafts 25, associated planetary gears 29 and cap gripper wheel 21, to the rotatable outer ring 31.

In order to operatively connect the rotatable cap gripping and loosening mechanism 11 to the power or drive train mechanism 15, the center drive shaft 41 is provided. The center drive shaft 41 is rotatably supported within ball bearings 43 received within an inside opening 34 of the hub or projection 33 of the main body frame 7. The lower end of the center drive shaft 41 has an enlarged head 45 that receives thrust bearings with disks 47 on opposite sides of a securing plate 49. The securing plate 49 is attached to the rotatable outer ring 31 by any suitable fastening means.

Also fixedly mounted to the center drive shaft 41 by shaft keys or the like is a center lower gear 51 having an upper portion 53 which is received within the opening 34 of the upstanding hub or projection 33 of the main body frame 7 for centered and aligned rotation therewithin. The lower portion 55 of the center lower gear 51 has an outer gear face for cooperative driving engagement with each of the three planetary gears 29 for operating the rotatable cap gripping and loosening mechanism 11, as will be described.

A friction disk or ring 57 is mounted between the upper face of the rotatable outer ring 31 and internal surface of the main body frame 7, as best seen in FIG. 2. The friction disk or ring 57 serves as a friction clutch to limit rotation of the rotatable outer ring 31 until overcome by the torquing force required to loosen a threaded cap assembled to an associated container. The anti-rotation friction forces associated with the friction disk or ring 57 may be preset by applying pressure between the anti-friction disk or ring 57 and the loading pucks 59 which are spring loaded by the springs 61 against the friction disk or ring 57. A securing nut 63 threadably attached to the center drive shaft 41 at the upper end thereof and the spring loaded pucks 59 cooperate together to adjustably pre-set the amount of pressure between the friction disk or ring 57 and the spring loaded pucks 61. This determines the amount of anti-rotation friction forces built into the rotatable cap gripping and loosening mechanism 11.

Reference is now made to FIG. 2 and 4B for a description of the power or drive train mechanism 15. In discussing the direction of rotation of the power or drive train components in FIGS. 2 and 4B, the direction of rotation will be viewed as seen from inside a container and looking up to a threaded cap mounted thereon, or as seen from looking up into the de-capping mechanism or assembly 3. Suitably shaped recesses are provided in the upper cavity 13 of the main body frame 7 for receiving the various components of the power or drive train mechanism 15. The reversible motor 67 is mounted within a suitable recess of the upper cavity 13 and has a capacitor 69 mounted in proximity thereto by way of the motor/capacitor support plate 71, as best seen in FIG. 4B. Also included in the motor electrical circuit are the relay 73 and terminal block 75.

Extending upwardly from the motor 67 is a rotating motor drive shaft 77 on which is secured to a motor drive gear 79. When the drive motor 67 starts, the upper or motor drive gear 79 is designed to be driven in a clockwise direction. A fixed shaft 81 is attached to linkage arm 95 which, in turn, is attached to the main body frame 7 and rotatably supports an intermediate gear 83. A pair of thrust bushings 85 are mounted on the fixed shaft 81 on opposite sides of the intermediate gear 83, and a snap ring 87 is attached adjacent the outer free end of the fixed shaft 81 to mount the intermediate gear 83 to the fixed shaft 81 in a secure and rotating position with respect thereto. The intermediate gear 83 is in cooperative mating engagement with the upper drive gear 79 such that as the upper drive gear 79 is driven in a clockwise direction, the intermediate gear 83 is driven in a counterclockwise direction. The intermediate gear 83, in turn, drives the main upper gear 91 which is rotatably mounted on the center drive shaft 41. Specifically, the main upper gear 91 is keyed to the center drive shaft 41 and has a bushing 93 between the ball bearings 43 and the main upper gear 91 on one side, while being secured to the shaft 41 by the securing nut 63 and associated washer 65 on the other side. The main upper gear 91 is driven in a clockwise direction by the intermediate gear 83. The intermediate gear shaft 81 is mounted to the linkage arm 95 which serves as a linking gear and idler arm for the intermediate drive gear 83 and main upper gear 91.

For economical reasons it may be desirable to eliminate the intermediate gear 83 and substitute chain sprockets for the motor drive gear 79 and the main upper gear 91 employing a chain in connection with these substituted chain sprockets, to provide the force to drive the center drive shaft 41. Quite obviously, these engineering adaptions are within the purview of the present invention.

When all the components of the power or drive train mechanism 15 are mounted within the upper cavity 13 of the main body frame 7, a suitable lid or cover 97 is mounted to the main body frame 7 in covering relationship thereto as shown in FIGS. 2 and 4B of the drawings.

Referring now to FIGS. 1 and 3 of the drawings, it will be further seen that the de-capping mechanism assembly 3 includes a start switch 100 which must be depressed to energize the power source connecting the electrical circuit (not shown) to the motor 67 for operating the de-capping mechanism or apparatus 3. A running indicator light 102 may be provided to visually indicate that the unit is in operation. A release switch button 104 may also be utilized to reverse the direction of the reversible drive motor 67 at any time during the operational cycle to return all of the operating components to an original ready position, as will be subsequently discussed. In FIG. 3 of the drawings, a pair of adjacent limit switches 106, 108 have juxtaposed switch arms 110 which are arranged to be engaged by a pin 112 attached to the main upper gear 91. Depending on the direction of rotation of the main upper gear 91, either the limit switch 106 or limit switch 108 will be activated as the pin 112 engages the juxtaposed switch arms 110. In loosening a threaded cap assembled to an associated container, the main upper gear 91 is driven in a clockwise rotation, and this rotation will continue until the pin 112 engages the juxtaposed switch arms 110 which depress the switch button activating the reverse switch 108. At this point, the reverse switch I08 will energize the reversible motor 67 to return all of the rotating components of the rotatable cap gripping and loosening mechanism 11 to an original ready position, and in completing the rotation, the pin 112 attached to the main upper gear 91 will engage the juxtaposed switch arms 110 and then depress the switch button activating the stop switch 106 to turns off the electrical circuit and all operating components. The release switch 104 may also be depressed if an operator elects not to allow the unit to fully complete its operation which will reverse the direction of the drive motor 67 to also return all of the rotating and operating components of the rotatable cap gripping and loosening mechanism 11 to their original ready position.

The standard operation of the threaded cap untorquer/de-capping mechanism or assembly 3 is as follows, remembering again that the direction of rotation is viewed by one looking up into the de-capping mechanism or assembly 3:

The start button 100 is depressed to energize electrical power to the drive motor 67. The drive motor 67 starts and rotates the upper drive gear 79 clockwise which, in turn, drives the upper intermediate gear 83 counterclockwise, the latter in turn, driving the main upper gear 91 clockwise. Since the main upper gear 91 is keyed to the center drive shaft 41, clockwise rotation of the main upper gear 91 causes the shaft 41 to rotate in a clockwise direction, thus rotating the center lower gear 51, keyed to the center drive shaft 41, also in a clockwise direction. The center lower gear 51 then rotates all three of the planetary gears 29 simultaneously in a counterclockwise direction. Each planetary gear 29 has the cap gripper wheel 21 with eccentric gripper bands 23 rigidly attached thereto. As the three planetary gears 29 rotate counterclockwise simultaneously, the rigidly attached cap gripper wheels 21 rotate causing the eccentric gripper bands 23 to rotate inward toward the center of the de-capping mechanism or assembly 3. The apparatus is designed so that if the de-capping mechanism or assembly 3 is left unattended or is operated without a threaded cap in position for engagement, the eccentric gripper bands 23 will rotate approximately 20° beyond and/or over center, and the unit will automatically reset itself to the ready position as the pin 112 engages the juxtaposed switch arms 110 engaging first the reverse switch 108, and following reverse and opening operation of the de-capping mechanism or assembly 3, engaging the stop switch 106.

Figure 8:
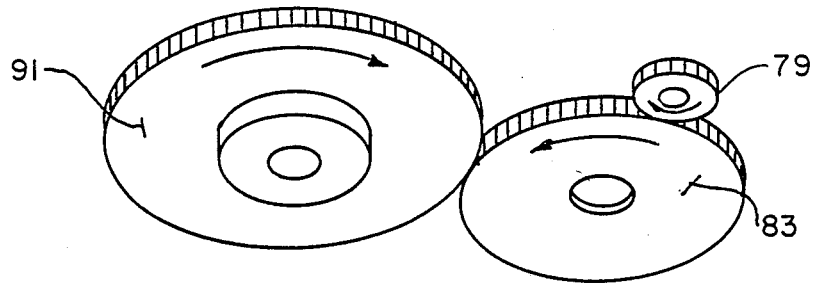
FIG. 8 is a fragmentary isometric view looking upwardly from the bottom which illustrates the gear drive train incorporated in the de-capping mechanism of the present invention.
Figure 8:
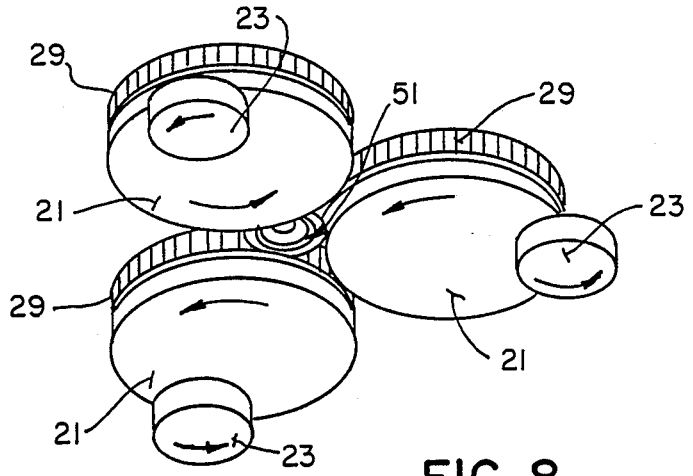

The aforementioned clockwise and counterclockwise movement of the gear drive train and the cap gripper wheels 21 is best illustrated in FIG. 8 of the drawings. Again, the view is looking up into the de-capping mechanism or assembly 3. There, it will be seen that the upper drive gear 79 is driven in a clockwise direction and which drives the intermediate gear 83 in a counterclockwise direction which, in turn, drives the main upper gear 91 in a clockwise direction. The center lower gear 51 is also driven in a clockwise direction corresponding to the main upper gear 91, and rotates each of the three planetary gears 29 in a counterclockwise direction.

Figure 9:
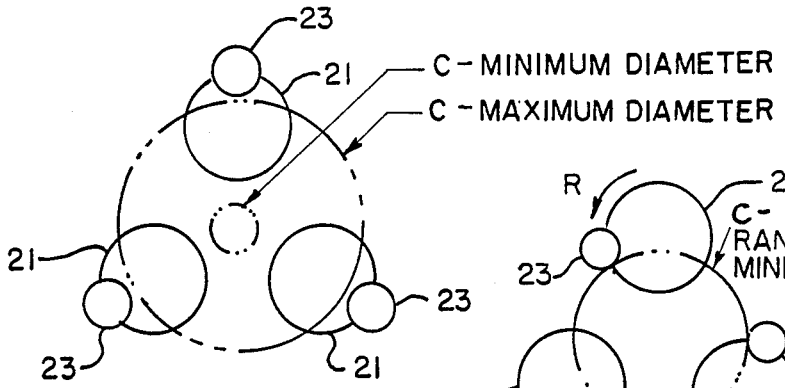
FIG. 9 is a bottom plan diagrammatic view illustrating the initial position of a jar cap in the de-capping mechanism prior to operation of the de-capping mechanism.
Figure 10:
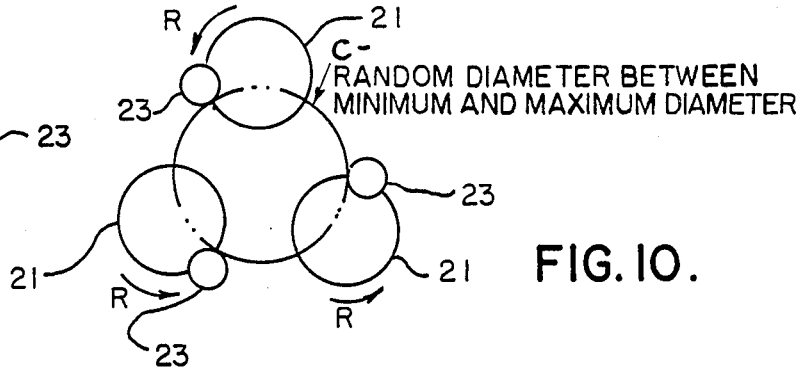
FIG. 10 is a bottom plan diagrammatic view illustrating the jar cap being circumferentially gripped by gripping elements of the de-capping mechanism.
Figure 11:
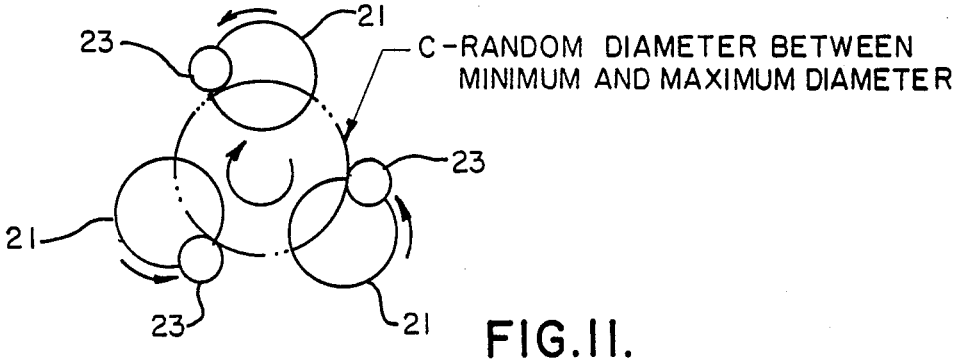
FIG. 11 is a bottom plan diagrammatic view illustrating rotation of gripping elements of the de-capping mechanism as a unit in order to loosen the jar cap from its associated container.

Referring now to FIGS. 2, 8 and 9–11 of the drawings, the manner in which the three planetary gears 29 simultaneously rotate counterclockwise the rigidly attached cap gripper wheels 21, relative to a cap generally identified by the phantom circle C in FIGS. 9–11 of the drawings, will now be described. It will be understood that the FIGS. 9–11 views are diagrammatic bottom plan views of the de-capping mechanism or assembly 3 illustrating the location of the cap gripper wheels 21, complete with eccentric gripper bands 23, in an open position (FIG. 9) and showing in phantom lines a cap C of maximum diameter and a cap C of minimum diameter capable of being engaged by the de-capping mechanism or assembly 3; the location of the cap gripper bands 23 as they move toward and circumferentially grip a cap C having a random diameter between maximum and minimum cap gripping diameters (FIG. 10), and the manner in which the cap gripper wheels 21 are driven as a unit while the cap C is gripped by the eccentric gripper bands 23 (FIG. 11).

The open or ready position is shown in FIG. 9 of the drawings and the cap gripper wheels 21, complete with eccentric gripper bands 23, are in a stationary position prior to operation of the threaded cap loosening apparatus 1. After a threaded cap mounted container is inserted into the threaded cap loosening apparatus 1, the start switch 100 will be operated. This will cause a gear or drive train mechanism to operate, in the manner described above, causing the cap gripper wheels 21 to rotate simultaneously in a counterclockwise direction until the three cap gripper bands 23 come into simultaneous circumferential contact with the threaded cap C assembled to an associated container, as shown in FIG. 10. At this time, the three cap gripper wheels 21 will have the eccentrically positioned cap gripper bands 23 in circumferential gripping engagement with the outer peripheral surface of the threaded cap C. The eccentrically positioned cap gripper bands 23 of each of the three cap gripper wheels 21 will begin to apply inward forces against the threaded cap C. This is represented by the arrows shown in FIG. 11 of the drawings. When this applied force against the threaded cap C exceeds the anti-rotation frictional forces of the friction clutch represented by the friction disk or ring 57, the entire rotatable cap gripping and loosening mechanism represented by the rotatable outer ring 31, each of the cap gripper wheels 21 and integral cap gripper bands 23, the outer rotating ring segment 32 attached to and depending from the outer rotatable ring 31, and the included three planetary gears 29, will rotate as a unit on the center drive shaft 41 as the center lower gear 51 drives the planetary gears 29 and each of these components in a clockwise direction, as viewed looking up into the threaded cap C and the de-capping mechanism or assembly 3, to loosen the threaded cap C assembled to its associated container.

This clockwise rotation of the aforementioned rotatable cap gripping and loosening mechanism will continue until the reversing limit switch 108 is operated as the pin 112 attached to the main upper gear 91 engages the juxtaposed switch arms 110, to reverse the drive motor 67. This will cause the entire de-capping mechanism or assembly 3 to reverse and return each of the rotatable components to an open and ready position. If the operator elects not to allow the unit to fully complete its operation, the operator can also push the release switch 104 which is also electrically interconnected in the electrical circuit to reverse the direction of the drive motor 67, thus opening the three gripper bands 23 and returning all of the rotating parts, the rotatable outer ring 31, the depending rotatable outer ring segment 32, the cap gripper wheels 21, the planetary gears 29 and the associated pin 112 of the main upper gear 91 to its original open and ready position.

Reference is now made to FIGS. 1 and 5–7 for a description of the elevator mechanism or assembly 5 which facilitates one-handed operation of the threaded cap loosening apparatus I of the present invention. The elevator mechanism or assembly 5 includes a manually engageable elevator arm 120, which includes a generally transversely directed integral linkage arm 122 for raising and lowering a pair of space elevator side rails 124. One of the elevator side rails 124 is connected to the linkage arm 122. Specifically, the free end of the linkage arm 122 includes an elongated slot 126 for receiving the free end of a horizontally positioned stub shaft 128 extending from the upper end of an adjacent elevator side rail 124. Suitable bearings 130, bushings 132 and snap rings 134 are available for assembling linkage arm portion 122 of the elevator arm 120 to the stub shaft 128. A corresponding linkage arm 123, includes an elongated slot 126, is assembled to the other stub shaft 128 at the upper end of the other elevator side rail 124, with suitable bearings 130, bushings 132 and snap ring 134.

Figure 7:
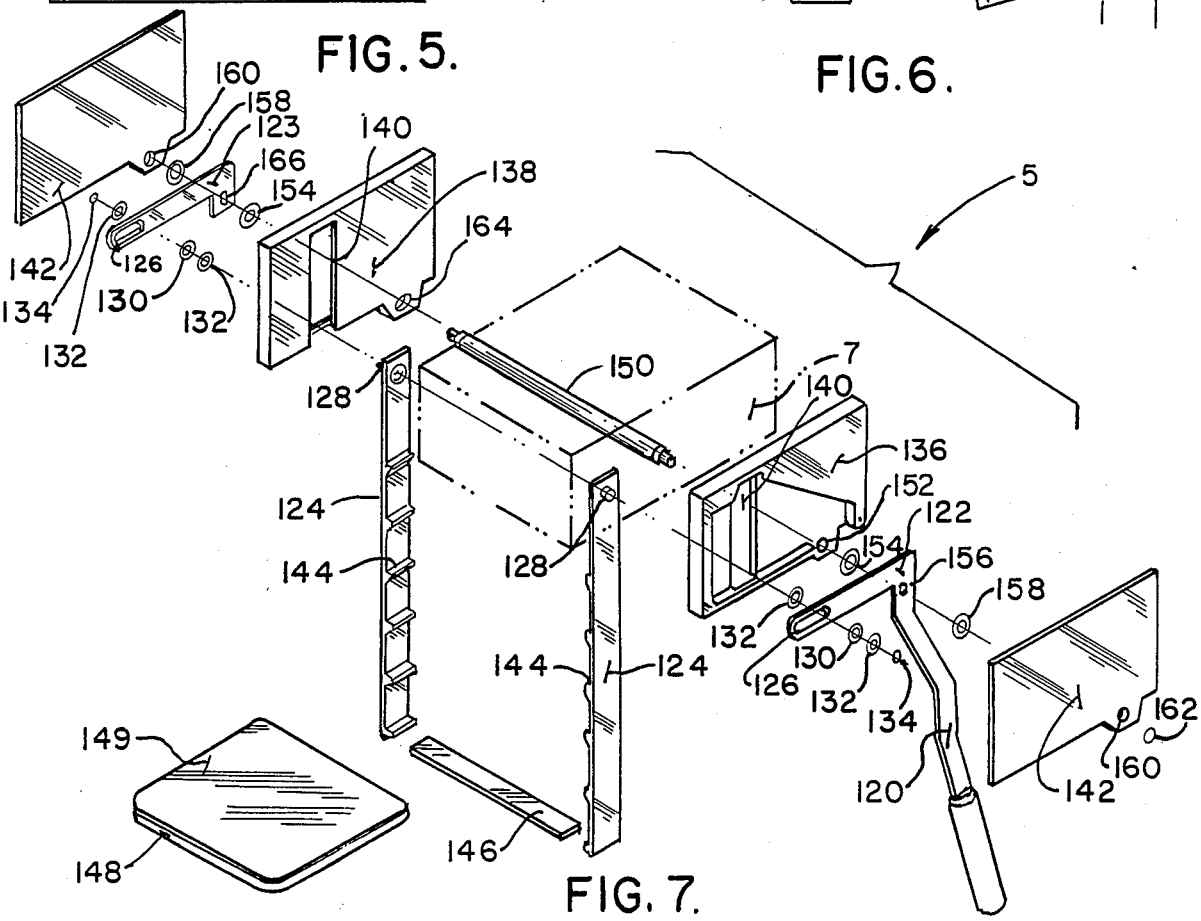
FIG. 7 is an exploded isometric view showing each of the components of the elevator mechanism.

Housing side plates 136, 13B are mounted to the main body frame 7 at opposite ends of the frame in the position illustrated in FIG. 7 of the drawings. The housing side plate 136 is positioned between the elevator arm 120 and main body frame 7 on one side thereof, and the housing side plate 138 is positioned between the linkage arm 123 and the main body frame 7 on the other side. A horizontally extending shaft 150 is positioned below the main body frame 7 and has one end extending through an opening 152 of the side plate 136, then through a bushing 154, through an opening 156 in the elevator arm 120, through a bushing 158, and finally through an opening 160 in the housing side cover 142, the outer free end of the horizontally extending shaft 150 then having a retainer 162 mounted thereon for securing the aforementioned components thereto. Similarly, the opposite free end of the shaft 150 extends through an opening 164 in the side plate 138, then through a bushing 154, through an opening 166 in the linkage arm 123, through a bushing 158, and finally through an opening I60 in the opposite housing side cover 142, the outer free end of the horizontally extending shaft then having a retainer (not shown) mounted thereon for securing the aforementioned components thereto.

Figure 6:
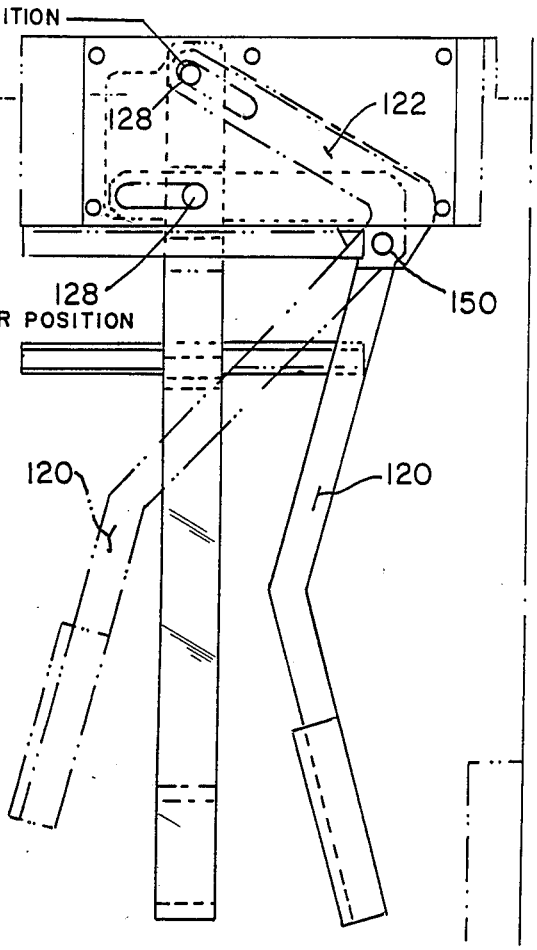
FIG. 6 is a side elevational view, partially in solid and phantom lines, illustrating the movement of a manually engageable handle associated with the elevator mechanism.

Each of the housing side plates 136, 138 also have complementary, generally vertically directed and elongated slots 140, 140 which are complementary shaped relative to the elevator side rails 124, 124 for slidable receipt therein. By raising and lowering the elevator arm 120, the elevator side rails 124, 124 slide within corresponding elongated slots 140, 140, while the linkage arm 122 of the elevator arm 120 and the linkage arm 123 pivotally move in conjunction with shaft 150. The stub shafts 128 of the elevator side rails 124, moves between lower and upper positions, as the elongated slots 126 of the linkage arms 122 and 123 are moved in various angular positions by the elevator arm 120 and linkage arms 122 and 123 pivotally move in conjunction with shaft 150, as seen in FIG. 6.

The side rails 124, 124 have an associated base bar 146 to hold them in a stable and fixed position The side rails 124, 124 further have a series of corresponding steps 144 which are horizontally aligned with one another for receipt and locking of the elevator platform 148 at various positions. The elevator platform 148, top surface covered with an anti-rotation friction membrane 149, can be positioned at various steps 144 of the spaced elongated side rails 124, 124, depending of the height of the threaded cap mounted container. Of course, since the elevator side rails 124, 124 can move only a limited vertical dimension within the corresponding elongated slots 140, 140, the user will have to select the step 144 that will receive the container on the elevator platform 148 and allow the necessary movement for engagement by the de-capping mechanism or assembly 3.

The operation of the elevator mechanism or assembly 5 is as follows:

The operator will manually place the elevator platform 148 at the proper elevation on the side rails 124, 124 prior to operation of the unit. This position is determined by the operator in order to ensure that full engagement of the threaded cap will be engaged by the de-capping mechanism or assembly 3. The bottle or jar with its threaded cap assembled thereto is then placed on the center of the elevator platform 148. The threaded cap mounted container is then elevated by pulling the elevator arm 120 towards the operator. As viewed in FIG. 1, the elevator arm 120 will be moved toward the left of the drawing. The elevator mechanism or assembly 5 will cease to rise when the threaded cap comes into direct contact with the de-capping mechanism or assembly 3. The operator will first press the start switch 100 on the de-capping mechanism or assembly 3. Since the de-capping mechanism or assembly preferably rotates slowly, the operator will be able to engage the elevator arm 120 after the start switch 100 is depressed, thereby permitting one-handed operation by handicapped persons. The operation of the de-capping mechanism or assembly will proceed as described above. The unscrewing of the threaded cap from its associated container will cause the elevator arm 120 to move away from the operator, thus allowing the threaded cap sufficient space to release from its associated container. The de-capping mechanism or assembly 3 will automatically release the threaded cap when it has completed its cycle. The elevator mechanism or assembly 5 may then be lowered by allowing the elevator arm 120 to return to its rest position.

From the foregoing, it will be appreciated that the threaded cap loosening apparatus and method of the present invention permits the de-capping mechanism to circumferentially engage and loosen a threaded cap from an associated container. The de-capping mechanism is automatically adjustably pre-positioned relative to threaded caps of different diameter which are assembled to associated containers. This is made possible by the eccentrically positioned cap gripper bands and the friction clutch enabling automatically adjustable circumferential gripping and peripheral engagement with a threaded cap assembled to an associated container. When the applied force from the cap gripper bands exceeds the anti-rotation friction forces of the friction clutch, the entire de-capping mechanism will rotate as unit, while the cap gripper bands maintain a continuous circumferential gripping force on the threaded cap. This provides the desired clockwise movement, as viewed looking upward from inside a container, to permit loosening of a threaded cap from its associated container for removal therefrom. An elevator mechanism may also be associated with the de-capping mechanism to facilitate vertical and horizontal alignment of a threaded cap in a threaded cap mounted container relative to the de-capping mechanism for the aforesaid de-capping operation. Numerous other features and advantageous results are also obtained, as set forth above, in accordance with the objects of the invention as will now be understood.

As various changes could be made in the above constructions and methods without departing from the scope of the invention, it is intended that all matter contained in the above description or shown in the accompanying drawings shall be interpreted as illustrative and not in a limiting sense.

I claim:

1. Apparatus for loosening threaded caps assembled to upper ends of containers, including:

a housing;

rotatable cap gripping and loosening means mounted in said housing;

circumferentially spaced and eccentrically mounted cap gripper elements operatively included in said rotatable cap gripping and loosening means;

gear train means mounted in said housing for rotating said cap gripper elements into circumferential gripping engagement relative to a threaded cap assembly to an associated container;

friction clutch means operatively associated with said gear train means for enabling said cap gripper elements to be rotated into circumferential gripping engagement relative to such threaded cap assembled to an associated container, said friction clutch means being overcome by torquing force necessary to loosen such threaded cap from its associated container;

said gear train means also being operative after said friction clutch means is overcome for driving said rotatable cap as a unit for imparting circumferential loosening forces to such threaded cap for loosening same from its associated container; and said rotatable cap gripping and loosening means includes said cap gripper elements, a planetary gear for each cap gripper element which is operatively engageable with said gear train means, and a rotatable outer ring carrying said cap gripper elements which is driven by each of said planetary gears when said friction clutch means is overcome.

2. The apparatus as defined in claim 1 wherein said gear train means as viewed looking up, includes a motor, an upper drive gear driven clockwise by said motor, an upper intermediate gear driven counterclockwise by the upper drive gear, a main upper gear driven clockwise by said upper intermediate gear, a center drive shaft keyed to said main upper gear and driven clockwise therewith, a center lower gear keyed to said center drive shaft in spaced position below said main upper gear and also driven clockwise with said center drive shaft, and circumferentially spaced planetary gears driven counterclockwise by said center lower gear for rotating each cap gripper element attached to a respective planetary gear in a counterclockwise motion toward such threaded cap of an associated container for gripping engagement therewith.

3. The apparatus as defined in claim 2 wherein said rotatable outer ring including said cap gripper elements are driven clockwise as a unit for loosening engagement with such threaded cap assembled to an associated container when said friction clutch means is overcome.

4. The apparatus as defined in claim 3 wherein said friction clutch means engages said rotatable outer ring to limit rotation thereof until said friction clutch means is overcome.

5. The apparatus as defined in claim 7 wherein said friction clutch means includes means for pre-setting the amount of frictional forces applied to said rotatable outer ring.

6. The apparatus as defined in claim 5 and including de-activating means to cause all of the operative components to return to an open position and stop operation.

7. The apparatus as defined in claim 6 wherein said de-activating means includes a reversing switch to reverse the operation of the motor to return the operative components to an open position and a shut-off switch.

8. The apparatus as defined in claim 1 wherein the friction clutch means engages and limits the rotation of said rotatable outer ring for automatically adjustable pre-positioning of said cap gripper elements in gripping engagement to threaded caps of different diameters, said rotatable outer ring including cap gripper elements being driven by said planetary gears when said friction clutch is overcome for loosening such threaded cap from its associated container.

9. The apparatus as defined in claim 1 and including elevator means for vertically and horizontally aligning a threaded cap of a threaded cap mounted container relative to said rotatable cap gripping and loosening means for operative engagement therewith.

10. The apparatus as defined in claim 9 wherein said elevator means includes an adjustably mounted platform for different sized containers and a manually engageable handle for raising and lowering said elevator means.

11. The apparatus as defined in claim 10 wherein said manually engageable handle is pivotally mounted to said housing and includes a linkage arm for raising and lowering a pair of spaced elevator side rails connected to said linkage arm.

12. The apparatus as defined in claim 11 wherein said linkage arm includes an elongated slot for receiving a stub shaft connecting an adjacent elevator side rail to said linkage arm, and said housing further including complementary slots formed in housing side plates for slidably receiving said side rails during said raising and lowering movement.

13. Apparatus for loosening threaded caps assembled to upper ends of containers, including:

powered circumferential gripping means for peripherally engaging a threaded cap assembled to an associated container, said circumferential gripping means including circumferentially spaced and eccentrically mounted cap gripper elements which are rotatably driven into circumferential gripping engagement relative to such threaded cap, said cap gripper elements being automatically adjustably positioned into circumferential gripping engagement relative to threaded caps of various diameters, powered de-capping means including said cap gripper elements which are driven together as a unit, following circumferential gripping engagement, to loosen such threaded cap from an associated container;

friction clutch means associated with said circumferentially spaced and eccentrically mounted cap gripper elements which is overcome by the torquing forces required to loosen such threaded cap to enable said cap gripper elements to be rotatably driven as a unit for loosening such threaded lid; and powered de-activating means for returning said circumferential gripping means to an open position after loosening a threaded cap for subsequent use and to stop operation of said apparatus.

14. The apparatus as defined in claim 13 and including elevator means for vertically and horizontally aligning a threaded cap of a threaded cap mounted container relative to said de-capping means for said aforesaid de-capping operation.

15. The apparatus as defined in claim 14 and including powered gear train means for rotating said gap gripper elements into circumferential gripping engagement relative to a threaded cap and for driving same as a unit to loosen such threaded cap from an associated container.

16. Apparatus for loosening threaded caps assembled to upper ends of containers, including:

a housing;

rotatable cap gripping and loosening means mounted in said housing;

circumferentially spaced and eccentrically mounted cap gripper elements operatively included in said rotatable cap gripping and loosening means;

gear train means mounted in said housing for rotating said cap gripper elements into circumferential gripping container;

motor means for driving said gear train means upon activation of a starting switch;

friction clutch means operatively associated with said gear train means for enabling said cap gripper elements to be rotated into circumferential gripping engagement relative to such threaded cap assembled to an associated container, said friction clutch means being overcome by torquing forces necessary to loosen such threaded cap from its associated container; and said gear train means also being operative after said friction clutch means is overcome for driving said rotatable cap gripping and loosening means including said cap gripper elements as a unit for imparting circumferential loosening forces to such threaded cap for loosening same from its associated container.

17. The method of loosening threaded caps assembled to the upper ends of associated containers including the steps of:

one-handed lifting of a threaded cap container to a predetermined position;

automatically applying an adjustable circumferential gripping force to the threaded cap at said predetermined position which varies with the diameter of the threaded cap;

imparting circumferential loosening forces to such threaded caps assembled to associated containers while maintaining said continuous circumferential gripping force at said predetermined position; and lowering the container from said predetermined position following removal of said threaded cap.

* * * * *

UNITED STATES PATENT AND TRADEMARK OFFICE

CERTIFICATE OF CORRECTION

PATENT NO. : 4,852,431

DATED : August 1, 1989

INVENTOR(S) : William L. Frangel

It is certified that error appears in the above-identified patent and that said Letters Patent is hereby corrected as shown below:

Column 3, line 54 is ":" should be -- ; --;

Column 9, line 25 is "I" should be -- 1 --;
Column 9, line 43 is"13B" should be -- 138 --;
Column 11, line 41-42 "assembly" should be -- assembled --;
Column 12, line 20 is "7" should be -- 4 --;
Column 13, line 31 is "gap" should be -- cap --; and
Column 14, line 5-6 is "gripping container;" should be --gripping engagement relative to a threaded cap assembled to an associated container;--

Signed and Sealed this

Twenty-second Day of January, 1991

*Attest:*

HARRY F. MANBECK, JR.

*Attesting Officer*

*Commissioner of Patents and Trademarks*